United States Patent [19]

Gatzke et al.

[11] Patent Number: 4,515,885

[45] Date of Patent: May 7, 1985

[54] DIAZO VESICULAR IMAGING FILMS WITH NITRATE SALT

[75] Inventors: Kenneth G. Gatzke, Lake Elmo; John M. Winslow, South Saint Paul, both of Minn.

[73] Assignee: Minnesota Mining and Manufacturing Company, St. Paul, Minn.

[21] Appl. No.: 518,955

[22] Filed: Aug. 1, 1983

[51] Int. Cl.[3] ..... G03C 1/60

[52] U.S. Cl. ..... 430/175; 430/169; 430/176; 430/177; 430/191; 430/192; 430/152

[58] Field of Search ..... 430/169, 176, 177, 192, 430/197, 281, 152, 191, 175

[56] References Cited

U.S. PATENT DOCUMENTS

| | | | |
|---|---|---|---|
| 2,908,572 | 10/1959 | Schoen et al. | 430/152 |
| 3,081,169 | 3/1963 | Parker et al. | 430/152 |
| 3,244,523 | 4/1966 | Growald et al. | 430/152 |
| 3,260,599 | 7/1966 | Lokken | 430/152 |
| 3,408,192 | 10/1968 | Aebi | 430/152 |
| 3,620,743 | 11/1971 | Notley | 96/49 |
| 3,622,336 | 11/1971 | Notley | 96/91 |
| 4,219,616 | 8/1980 | Pope et al. | 430/152 |
| 4,370,401 | 1/1983 | Winslow et al. | 430/178 |
| 4,394,433 | 7/1983 | Gatzke | 430/151 |

*Primary Examiner*—Charles L. Bowers, Jr.
*Attorney, Agent, or Firm*—Donald M. Sell; James A. Smith; Mark A. Litman

[57] ABSTRACT

Vesicular imaging films have good speed and stable latent images when comprised of a diazonium compound, nitrate salt, and binder comprising gelatin or poly(vinyl alcohol). The film can even have highly stable final images when the binder comprises poly(vinyl alcohol).

18 Claims, No Drawings

DIAZO VESICULAR IMAGING FILMS WITH NITRATE SALT

BACKGROUND OF THE INVENTION

The present invention relates to photosensitive imaging systems, and particularly diazonium vesicular imaging systems.

Vesicular images are formed in a photosensitive film by small bubbles or vesicles of gas which are formed and trapped in the areas of the film exposed to light. Generally speaking, the film has a colloid or a resin coating, referred to as a vehicle, on a backing material and a light-sensitive agent, most commonly a diazo compound, dispersed throughout the coating. When the film is selectively exposed to imagewise distributed radiation, the light-sensitive agent is decomposed and releases molecules of a gas (nitrogen in the case of diazo compounds). The gas ordinarily may be dissolved in the coating and does not form vesicles immediately, but does so when the film is developed by heating, presumably because the vehicle is softened sufficiently on heating for the gas molecules to form bubbles in the vehicle and for the bubble to expand. The resulting vesicles make the vehicle opaque to transmission of light in the imagewise exposed areas. The vesicles also reflect and scatter light so that they appear white.

Early vesicular materials employed gelatin as the vehicle. These suffered from the difficulties of slow speed, short-lived latent images, and rapid fading of the vesicular images. Later work revealed that this last problem was caused, in part, by the sensitivity of gelatin to water. Gelatin vehicles absorbed moisture from the atmosphere and became soft, thus collapsing the vesicles and destroying the image.

It is now preferred to employ polymers or resins as the vehicle. Vehicles which are particularly preferred include those described in U.S. Pat. Nos. 3,620,743 and 3,622,336. U.S. Pat. No. 3,620,743 discloses a vehicle made from a water-insoluble polymer selected from a group consisting of homopolymers of α-chloroacrylonitrile and copolymers of α-chloroacrylonitrile with a different vinyl monomer in which the mole fraction of the vinyl monomer in the copolymer is less than 0.50. U.S. Pat. No. 3,622,336 discloses a vehicle which is a copolymer of α-chloroacrylonitrile and α-methacrylonitrile.

It would be desirable to use water-soluble vehicles in the manufacture of vesicular films as this would remove the cost of organic solvents and reduce the manufacturing costs and health risks involved in working with organic solvents. Previous attempts to use water soluble resins such as poly(vinyl alcohol) have sought to prevent penetration of moisture into the vehicle by the application of a water-impermeable topcoat. This construction somewhat reduced the moisture sensitivity of the film, but images would still shortly fade because of the collapse of vesicles under ambient humidity conditions.

SUMMARY OF THE INVENTION

Vesicular imaging films having high speed, latent image stability and which can also have final image stability comprise radiation sensitive diazonium material and a nitrate salt in a water-soluble vehicle comprising either gelatin or poly(vinyl alcohol). Oxidation products generated from the photoinitiated decomposition of the nitrate by the diazonium material crosslink the poly(vinyl alcohol) and render it less water soluble in the image areas where vesicles are formed.

DETAILED DESCRIPTION OF THE INVENTION

A vesicular imaging film is constructed of a transparent or translucent support base and a photosensitive layer of a water-soluble polymeric binder comprising at least 30% by weight of either gelatin or poly(vinyl alcohol), a photosensitive diazonium component, and a nitrate salt. A topcoat of a water vapor-resistant polymer is optionally used over the photosensitive layer.

The water-soluble polymeric binder should preferably comprise at least 50% by weight of gelatin or poly(vinyl alcohol). Preferably the binder comprises at least 75% by weight of gelatin or poly(vinyl alcohol), more preferably 90% by weight gelatin or poly(vinyl alcohol) and most preferably 100% gelatin or poly(vinyl alcohol). The other binder components should blend well with the gelatin or poly(vinyl alcohol) and be water soluble to a degree themselves. The preferred material for the other binder component wound be vinyl ether/maleic acid copolymers such as Gantrez ® resins. The binder system must be sufficiently water soluble to be applied from an aqueous (e.g., 90% water, 10% ethanol by volume) or solely water solvent system.

Light sensitive diazonium materials such as polymers, oligomers and salts are well known in the art. These salts comprise a light sensitive aromatic nucleus with an external diazonium group and an anion associated therewith (e.g., *Light-Sensitive System,* Kosar, pp. 202–214, John Wiley and Sons, Inc. 1965, N.Y.; and *Photographic Chemistry,* Vol. II, P. Glafkides, pp. 709–725, Fountain Press, London). They may be generally represented by the formula:

$$ArN{\equiv}N^{+}X^{-}$$

wherein Ar is an aromatic nucleus, and $X^-$ is an anion.

Any anion may be used on the diazonium salt. Anions as diverse as zinc chloride, tri-isopropyl naphthalene sulfonate, fluoroborate (i.e., $BF_4^-$), and bis(perfluoroalkylsulfonyl)methides may be used. The change in anions may affect the speed of the imaging layer, but not its function. Preferably the anion is selected to increase the water solubility or compatibility of the compound. Any light sensitive aromatic diazonium nucleus, as known in the art, may also be used in the practice of the present invention. These nuclei are well known in the art and include, for example, p-anilinobenzene; 1-diazo-2,4-diethoxy-4-morpholino benzene; 1-diazo-4-benzoyl amino-2,5-diethoxy benzene; 4-diazo-2,5-dibutoxy phenyl morpholino; 4-diazo-1-dimethyl aniline; 1-diazo-N,N-dimethyl aniline; 3-methyl-4-pyrrollidone benzene; 1-diazo-4-N-methyl-N-hydroxyethyl aniline; etc. Light sensitive oligomeric diazonium resins as known in the art (e.g., U.S. Pat. No. 2,714,066) are useful and are specifically included within the definition of diazonium salts as they are merely condensation products of the salts (with aldehydes such as formaldehyde) and retain their light sensitive and active properties. Diazo oxides are also equally useful in the present invention and are included in the term diazonium materials.

The nitrate salt component is believed to be desired in a form that is capable of generating an oxidizing component (e.g., $HNO_3$, NO, $NO_2$ or $N_2O_4$) in combination with the diazonium salt when light struck and heated for development of the vesicles. The oxidizing component should thus be generable after being irradiated in the presence of a diazonium material sensitive to the incident radiation and heated to a temperature between 160° and 250° C. for one minute. No nitrate salts have as yet been tested which do not accomplish this, but nitric acid alone will not work well in this manner as it is already an active oxidizing agent.

The nitrate salt component of the present invention is preferably in a form within the imaging layer so that $HNO_3$, NO, $NO_2$ or $N_2O_4$ will be provided within the layer when it is heated to a temperature no greater than 200° C. for 60 seconds and preferably no greater than 160° C. for 60 or most preferably 30 seconds. This may be accomplished with many different types of salts, both organic and inorganic, and in variously different types of constructions.

The most convenient way of providing such thermal oxidant-providing nitrate salts is to provide a hydrated nitrate salt such as aluminum nitrate nonahydrate ($Al(NO_3)_2,9H_2O$). This salt, when heated in a binder, will generate $HNO_3$, NO, $NO_2$ and/or $N_2O_4$ in various amounts. The binder should not be at such a high pH that the liberated nitric acid would be immediately neutralized as this would adversely affect the oxidizing capability of the system. It is not essential that a completely acidic or neutral pH environment be provided, but pH levels above 8.5 may in many cases completely prevent oxidation. It is, therefore, desired that the nitrate salt containing layer have a pH less than 7.5, preferably equal to or less than 7.0, and more preferably equal to or less than 6.5.

In addition to hydrated nitrate salts, non-hydrated salts in layers having a pH less than 7.5, and preferably in an acidic environment are also capable of providing $HNO_3$, NO, $NO_2$ and/or $N_2O_4$ in sufficient quantities to provide the oxidizing capability necessary for practice of the present invention. Ammonium nitrate, for example, does not enable good oxidation in the present invention in a layer having a pH of 8.0 or higher, but when a moderate strength organic acid such as phthalic acid is added to lower the pH to below 7.0, a quite acceptable imaging system is provided.

Beside the inorganic types of salts generally described above, organic salts in non-alkaline environments are also quite useful in the practice of the present invention. In particular, nitrated quaternary ammonium salts such as guanadinium nitrate work quite well in acid environments, but will not provide any useful image at alkaline pH levels of 8.0 or higher.

It is believed that the alkaline environment causes any oxidizing agent (e.g., $HNO_3$, NO, $NO_2$ and/or $N_2O_4$) which is liberated from the nitrate salt to be preferentially reacted with hydroxy ions or other neutralizing moities so as to prevent oxidation of the dyes. For this reason it is preferred to have the environment of the nitrate salt at a pH no greater than 7.0 and more preferably less than 6.5.

Preferred salts are the hydrated metal salts such as nickel nitrate hexahydrate, magnesium nitrate hexahydrate, aluminum nitrate nonahydrate, ferric nitrate nonahydrate, cupric nitrate trihydrate, zinc nitrate hexahydrate, cadmium nitrate tetrahydrate, bismuth nitrate pentahydrate, thorium nitrate tetrahydrate, cobalt nitrate hexahydrate, gadolinium or lanthanum nitrate nonahydrate, mixtures of these hydrated nitrates and the like. Non-hydrated or organic nitrates may be admixed therewith.

Organic nitrates are also quite useful in the practice of the present invention. These nitrates are usually in the form of quaternary nitrogen containing compounds such as guanadinium nitrate, pyridinium nitrate, and the like. Ammonium nitrate may also be used. Nitrated dyes will also be useful, but again, they must be used in an environment which will not neutralize any liberated $HNO_3$, NO, $NO_2$ and/or $N_2O_4$.

Acids and acidic materials are preferably present in the photosensitive layer along with the diazonium materials, not only to provide an acidic environment, but also to stabilize the diazonium materials. Organic acids are preferred, but inorganic acids are also useful, although generally in smaller concentrations. Organic acids having carboxylic acids are generally preferred, and aromatic carboxylic acids such as phthalic acid, isophthalic acid and the like are particularly desirable.

The proportions of the ingredients have been found to be critical in the practice of the present invention. The use of proportions outside of the following range has been found to produce very poor images, with either high $D_{min}$ or low $D_{max}$. Considering only the proportions of the required three components, the following range of weight concentrations must be used in order to provide good quality images. The binder must comprise 70–95% by weight of the layer, the diazo material must comprise from 0.08 to 3.5 percent by weight, and the nitrate must comprise from 4.5 to 25% by weight of the layer. Preferably, the binder comprises 75 to 90%, the diazo comprises from 0.1 to 3%, and the nitrate comprises from 6 to 20% by weight of the layer. Most preferably the binder comprises from 80 to 90%, the diazo comprises from 0.25 to 2.5%, and the nitrate comprises from 8 to 15% by weight of the photosensitive layer. The improvement obtained by restricting the compositions to the narrow most preferred range are significant, even over other compositions within the broad range.

Other additives may also be present in the photosensitive layer or on the composite article. For example, priming layers may be on the translucent or transparent support, and coating aids, lubricants, antistatic agents, antioxidants and the like may be present in the photosensitive layer and/or the optional moisture resistant top layer. It is generally not desirable to use dyes or pigments in the photosensitive layer as this tends to increase the background density ($D_{min}$) on projection of the image. Even though dark or black images on a colored background can thus be projected, it is preferred that there be insufficient dye in the photosensitive layer to provide a transmission optical density of 0.3. It is more preferred that there be substantially no dye in the photosensitive layer. By substantially no dye in the layer, it is meant that there is a transmission optical density of less than 0.10 in the photosensitive layer.

These and other aspects of the invention will be shown in the following non-limiting examples.

EXAMPLE 1

This Example shows the effect of nitrate salt addition on the formation of a vesicular image in a poly(vinyl alcohol) binder.

42.0 grams of a poly(vinyl alcohol) polymer (Elvanol 71-30) as solution of 10% solids with 5% ethanol and 85% by weight water was combined with 0.2 grams of the diazonium salt, 1-diazo-3-methyl-4-pyrrolidinobenzene zinc chloride. One half of this composition was removed (Sample A) and the remaining half was combined with 2 grams of zinc nitrate. Two strips of polyester were coated at a thickness of 4 mils wet thickness and dried for seven minutes at 70° C. Each sample was then exposed for 1.3 minutes through a 0–4 continuous density wedge to a ultraviolet radiation source (mercury halide lamp). The samples were then heat developed at 102° C. for seven seconds. The results were as follows:

| | $D_{max}$ | $D_{min}$ |
|---|---|---|
| Sample A | 0.23 | 0.06 |
| Sample B | 2.03 | 0.06 |

A second strip of Sample A was exposed as before and imaged at 138° C. to evaluate the effects of development temperature on the system. A $D_{max}$ of only 0.24 and a $D_{min}$ of 0.06 were obtained. The dramatic gain in optical density from the nitrate salt can be readily noted.

EXAMPLE 2

A comparison between a vesicular film containing nitrate according to the present invention and a commercial vesicular film is made in this Example. A solution was made of the ingredients:

4 g Cerric Magnesium Nitrate ($Ce_2Mg(NO_3)_{12}.24H_2O$)
1 g Aluminum Nitrate ($Al(NO_3)_3.9H_2O$)
0.01 g Phenidone A
0.04 g Diazo salt of Example 1

The above solution was dissolved in 2 g distilled $H_2O$ then the following polymer solutions were added:

10 g Elvanol 85-80 solution (10 g PVA, 5 g ethanol, 85 g $H_2O$)
10 g Elvanol 71-30 solution (10 g PVA, 5 g ethanol, 85 g $H_2O$)

The resulting solution was coated at 4 mils over a polyester base and dried for 12 minutes at 70° C. A sample was then imaged through a 0–4 wedge on a 3M Model 261 ultraviolet imaging apparatus for 77.1 seconds and subsequently developed at 102° C. for 7 seconds. 3M Brand VMCB vesicular film (a diazonium salt in a poly-α-chloroacrylonitrile polymer) was imaged in the same way and developed at 126° C. for 4 seconds. The results are as follows:

| | $D_{min}$ | $D_{max}$ | Speed Pt. at D = .6 | Contrast |
|---|---|---|---|---|
| Type VMCB | .14 | 1.77 | 3.34 | 2.76 |
| PVA + Nitrate | .05 | 1.59 | 1.33 | 0.73 |

The sample containing the PVA+Nitrate demonstrates a speed increase of 2 orders of magnitude over the standard vesicular film and a lower $D_{min}$.

EXAMPLE 3

Latent image retention of the films of the present invention are examined in this Example. A solution was prepared as follows:

2 g Cerric Magnesium Nitrate were mixed with 0.04 g of the diazonium salt of Example 1 and then mixed with 20 grams of the resin combination used in Example 2.

The solution was coated at 4 mils on a polyester film and dried for 12 minutes at 70° C. The film was then overcoated with the following solution at 3 mils and dried for 10 minutes at 70° C.

30 g Saran F310 (polyvinylidene chloride) Resin
5 g tetrahydrofuran
3.4 g Syloid R-972 (hydrophobic silica particles)
61.6 g MEK The Saran functions as a moisture barrier. Two samples were exposed as in Example 2. One was immediately developed at 250° F. for 4 seconds. The other was held at room temperature for 24 hours in the dark and then developed in the same manner. Results are as shown:

| | $D_{min}$ | $D_{max}$ | Speed Pt. at D = .6 | Contrast |
|---|---|---|---|---|
| Original | .05 | 1.82 | 2.87 | 1.33 |
| 24 hour | .05 | 1.70 | 2.87 | 1.31 |

The comparison demonstrates good latent image retention.

EXAMPLES 4–9

Various nitrates are shown as substitutions for the nitrates used in Example 2. Solutions were prepared of the following materials:

| Ex. | Nitrate | Diazo of Example 1 (grams) | Resin Solutions as in Ex. 2 | Grams of Nitrate |
|---|---|---|---|---|
| 4. | $Zn(NO_3)_2.6H_2O$ | .2 g | 20 g | 2 g |
| 5. | $NH_4NO_3$ | " | " | 1.08 g |
| 6. | $Co(NO_3)_2.6H_2O$ | " | " | 1.96 g |
| 7. | $Cd(NO_3)_2.4H_2O$ | " | " | 2.07 g |
| 8. | $Cu(NO_3)_2.3H_2O$ | " | " | 1.62 g |
| 9. | $Ni(NO_3)_2.6H_2O$ | " | " | 1.95 g |

The solutions were each coated at a wet thickness of 4 mils over a polyester substrate and dried for 6 minutes at 70° C. A second coating containing the following was prepared:

30 g Saran F310 (polyvinylidene Chloride)
5 g tetrahydrofuran
65 g methyl ethyl ketone The second coating was applied over the first coatings at a thickness of 3 mils (wet) and dried for 6 minutes at 70° C. The samples were exposed to a 0–4 wedge as before and developed for 10 seconds at 138° C. The results are shown in the following table.

| Example | $D_{min}$ | $D_{max}$ |
|---|---|---|
| 4 | .11 | 1.88 |
| 5 | .15 | 1.92 |
| 6 | .17 | 2.00 |
| 7 | .12 | 1.70 |
| 8 | .14 | 0.52 |
| 9 | .13 | 1.69 |

EXAMPLE 10

The moisture resistance of the developed image when practicing the present invention is shown in this Example. A solution was prepared of the following ingredients:

1.5 g Zinc Nitrate
0.6 g Aluminum Nitrate
0.08 g Diazonium salt (4-diazo-2,5-diethoxyphenylmorpholine borofluoride)
10 g Elvanol 85-80 Solution
10 g Elvanol 71-30 Solution The solution was coated at 4 mils over a polyester substrate and dried for 10 minutes at 70° C. An overcoat of Saran F310 as in Examples 4–9 was applied. Eight samples were imaged to a microfilm master for 9 seconds on the 3M Model 261. They were then developed in succession at increasing temperatures for 10 seconds.

| Development Temp. | $D_{min}$ | $D_{max}$ |
|---|---|---|
| 220° F. | .08 | .95 |
| 230 | .08 | 1.11 |
| 240 | .08 | 1.48 |
| 250 | .08 | 1.89 |
| 260 | .09 | 2.00 |
| 270 | .08 | 2.07 |
| 280 | .09 | 2.08 |
| 290 | .09 | 2.09 |

The developed samples were placed in an 80° F./80% RH room for 72 hours. The images in samples developed through 270° F. had disappeared. The samples developed at 280° and 290° F. had the following readings:

| Development Temp. | $D_{min}$ | $D_{max}$ |
|---|---|---|
| 280° F. | .08 | .96 |
| 290 | .08 | 1.96 |

A combination of nitrate and increased development temperature has a stabilizing effect on the resistance of the vesicles to collapse by moisture.

EXAMPLE 11

Comparison of various poly(vinyl alcohol) resins of varying viscosity and percent hydrolysis is shown. The comparison was made with Dupont's Elvanol series where grade destinations are made with 2 numbers. The number preceeding the hyphen is assigned by degree of hydrolysis and those following refer to viscosity.

Each solution was prepared according to the following formula:

2 g Zinc Nitrate
0.2 g Diazo salt of Example 1
20 g Resin Solution (10% Resin, 5% Ethanol, 85% $H_2O$)

They were each coated and overcoated as in Example 6. They were exposed as in Example 6 and developed for 10 seconds at 280° F.

| | | | Latent Image | | 80/80 Room 72 hours | |
|---|---|---|---|---|---|---|
| Resin | $D_{min}$ | $D_{max}$ | $D_{min}$ | $D_{max}$ | $D_{min}$ | $D_{max}$ |
| 71-30 | .13 | 1.98 | .12 | 1.06 | .49 | 1.01 |
| 75-15 | .11 | 1.87 | .11 | 1.28 | .29 | .89 |
| 85-50 | .11 | 1.71 | .11 | .11 | .12 | .35 |
| 85-60 | .10 | 1.81 | .11 | 1.55 | .15 | .95 |
| 85-80 | .11 | 1.51 | .02 | .09 | .09 | .16 |
| 85-82 | .11 | 1.83 | .11 | 1.66 | .16 | 1.04 |
| 90-50 | .10 | 1.85 | .11 | 1.31 | .16 | 1.21 |
| HV | .12 | 1.75 | .11 | 1.48 | .14 | 1.44 |

All samples gave good initial images. The data shows that some resins retain the latent image while others are more resistant to collapse of the vesicles by $H_2O$. The effect of increasing the percent hydrolysis or viscosity is not well defined.

EXAMPLE 12

A $2^4$ design was run. The resin solution consisted of 10 g Elvanol 85-60, 5 g Ethanol and 85 g $H_2O$. Zinc Nitrate was used as the nitrate source. The diazonium salt of Example 1 was used. The second trip was the Saran F310 solution described earlier. The design was run to examine the concentration effects on the image. The levels used were as follows:

| | −1 | 0 | +1 |
|---|---|---|---|
| A. Nitrate (grams) | 2.0 | 3.0 | 4.0 |
| B. Diazonium Salt (grams) | .1 | .2 | .3 |
| C. Resin Solution (grams) | 15 | 20 | 25 |
| D. 2nd Coat Orifice in mils | 2 | 3 | 4 |

Each design point was run once. The center point was replicated 4 times.

The samples were exposed to a 0–4 wedge for 77.1 seconds on the 3M Model 261 and developed for 10 seconds at 138° C. Results were as follows for 24 hour ambient conditions and 72 hours at 80° F. and 80% relative humidity storage:

| Trial | | | Latent Image 24 hours | | 80/80 Room 72 hours | |
|---|---|---|---|---|---|---|
| No. | $D_{min}$ | $D_{max}$ | $D_{min}$ | $D_{max}$ | $D_{min}$ | $D_{max}$ |
| 1 | .11 | 1.84 | .22 | 1.06 | .21 | 1.29 |
| 2 | .12 | 1.76 | .24 | .89 | .27 | .65 |
| 3 | .26 | 2.36 | 1.23 | 1.86 | 1.14 | 2.07 |
| 4 | .99 | 1.73 | .93 | 1.27 | .32 | .62 |
| 5 | .10 | .63 | .00 | .00 | .12 | .12 |
| 6 | .11 | 1.84 | .30 | 1.00 | .17 | 1.10 |
| 7 | .16 | 1.98 | .31 | 1.87 | .31 | 1.15 |
| 8 | .12 | 2.18 | .16 | 1.55 | 1.23 | 1.51 |
| 9 | .11 | 1.87 | .12 | 1.41 | .20 | 1.30 |
| 10 | .53 | 1.43 | .14 | .39 | .21 | .46 |
| 11 | .24 | 2.37 | 1.03 | 1.71 | 1.22 | 2.13 |
| 12 | 1.09 | 1.97 | .68 | 1.16 | .38 | .69 |
| 13 | .11 | 1.04 | .11 | .65 | .00 | .13 |
| 14 | .11 | 1.78 | .11 | 1.47 | .14 | .85 |
| 15 | .14 | 1.90 | .25 | 1.96 | .29 | .99 |
| 16 | .17 | 2.29 | .68 | 1.73 | 1.32 | 1.81 |
| 17 | .11 | 2.07 | .12 | 1.58 | .84 | 1.54 |
| 18 | .11 | 2.08 | .63 | 1.33 | .94 | 1.59 |
| 19 | .11 | 2.09 | .12 | 1.51 | .78 | 1.60 |
| 20 | .12 | 2.08 | .67 | 1.21 | .86 | 1.44 |

EXAMPLES 13–25

The criticality of the gelatin and poly(vinyl alcohol) as the binder in the vesicular imaging system of the present invention is investigated. Standard formulations were prepared of:

2.0 g resin binder
0.02 moles of nitrate
$2.8\times10^{-4}$ moles of diazonium salt
diluted to 25 g with solvent which were coated at 4 mils ($1.02\times10^{-4}$ m) wet thickness and dried at 95° C. The following resins and solvents were used:

13. Acrylic resin (Carboset 525)—20% in methylethyl ketone
14. Acrylic resin (Carboset 525)—20% methanol
15. Polyvinyl butyral (Butvar B72A)—15% methanol
16. Polyvinyl butyral (Butvar B73)—20% methanol
17. Acrylic resin (Acryloid B-66)—20% in methylethyl ketone
18. Polyester (Vitel 222)—20% in methylethyl ketone
19. Polyvinylidenechloride (Saran F-310)—20% in methylethyl ketone
20. Epoxy (Epon 1007)—20% in methylethyl ketone
21. Poly(vinyl chloride/vinyl acetate)—20% in methylethyl ketone 22. Poly-alpha-chloroacrylonitrile—20% in methyl-ethyl ketone
23. Inert gelatin—20% is distilled water
24. 95% phthalated gelatin—20% in distilled water
25. polyvinyl alcohol (Uvanol 85-60)—10% in 85% distilled water and 5% ethanol Both aluminum nitrate and zinc nitrate were used with the diazonium salt of Example 1. After exposure and development, only Examples 23–25 gave good quality images with $D_{max}$ of over 1.00. Example 22 provided the only readable image from amongst the other examples with a $D_{max}/D_{min}$ of 0.83/0.55 which is not considered satisfactory. The ratios for Examples 23–25, respectively were 1.63/0.04, 1.54/0.8 and 1.69/0.6. The criticility of the binder can be seen from this data.

We claim:

1. A vesicular imaging film comprising a transparent or translucent substrate having on at least one surface thereof a photosensitive layer at a pH level which is not above 8.5 comprising on a weight basis of said photosensitive layer:

a. 70–95% by weight of a water-soluble binder consisting essentially of poly(vinyl alcohol)
b. 0.08 to 3.5% by weight of a photosensitive diazo material, and
c. 4.5 to 25% by weight of a nitrate salt.

2. The film of claim wherein the pH of the photosensitive layer is below 7.0.

3. The film of claim 1 having a moisture resistant transparent film over said photosensitive layer.

4. The film of claim 2 wherein the photosensitive layer comprises 75 to 90% by weight of said water-soluble binder, 0.1 to 3% by weight of said diazo material, and 6 to 20% by weight of said nitrate salt.

5. The film of claim 1 wherein said diazo material is a photosensitive diazo salt.

6. The film of claim 4 wherein said diazo material is a photosensitive diazo salt.

7. The film of claim 1 wherein the photosensitive layer comprises 75 to 90% by weight of said water-soluble binder, 0.1 to 3% by weight of said diazo material, and 6 to 20% by weight of said nitrate salt.

8. The film of claim 7 wherein said diazo material is a photosensitive diazo salt.

9. The film of claim 2 wherein the photosensitive layer comprises 75 to 90% by weight of said water-soluble binder, 0.1 to 3% by weight of said diazo material, and 6 to 20% by weight of said nitrate salt.

10. The film of claim 9 wherein said diazo material is a photosensitive diazo salt.

11. The film of claim 1 wherein the photosensitive layer comprises 80 to 90% by weight of said water-soluble binder, 0.25 to 2.5% by weight of said diazo material and 8 to 15% by weight of said nitrate salt.

12. The film of claim 11 wherein said diazo material comprises a photosensitive diazo salt.

13. The film of claim 1 wherein said nitrate salt is a metal nitrate salt.

14. The film of claim 4 wherein said nitrate salt is a metal nitrate salt.

15. The film of claim 7 wherein said nitrate salt is a metal nitrate salt.

16. The film of claim 8 wherein said nitrate salt is a hydrated metal nitrate salt.

17. The film of claim 11 wherein said nitrate salt is a hydrated metal nitrate salt.

18. The film of claim 12 wherein said nitrate salt is a hydrated metal nitrate salt.

* * * * *

UNITED STATES PATENT AND TRADEMARK OFFICE

CERTIFICATE OF CORRECTION

PATENT NO. : 4,515,885

DATED : May 7, 1985

INVENTOR(S) : Kenneth G. Gatzke and John M. Winslow

It is certified that error appears in the above-identified patent and that said Letters Patent is hereby corrected as shown below:

Column 1, line 24, "bubble" should read --bubbles--.

Column 9, line 3, "is" should read --in--.

Claim 2, line 1, after "claim" insert --1--.

Signed and Sealed this

*Eighth* Day of *April 1986*

[SEAL]

*Attest:*

DONALD J. QUIGG

*Attesting Officer*

*Commissioner of Patents and Trademarks*